United States Patent [19]

McKenzie

[11] Patent Number: 4,740,183

[45] Date of Patent: Apr. 26, 1988

[54] COMPACT LIFE-SAVING SUIT

[76] Inventor: Clancy D. McKenzie, 905 Centennial Rd., Penn Valley, Narberth, Pa. 19072

[21] Appl. No.: 941,536

[22] Filed: Dec. 11, 1986

Related U.S. Application Data

[63] Continuation of Ser. No. 317,025, Nov. 2, 1981, abandoned.

[51] Int. Cl.[4] ..... B63C 9/12

[52] U.S. Cl. ..... 441/104; 441/102; 441/103; 2/2

[58] Field of Search ..... 441/80, 88, 115, 102–106, 441/125, 129; 2/2.1 R, 2.1 A, 81, 2

[56] References Cited

U.S. PATENT DOCUMENTS

| | | | |
|---|---|---|---|
| 1,070,705 | 8/1913 | Lackner | 441/103 |
| 1,113,074 | 10/1914 | Voegeli | 441/103 |
| 1,119,541 | 12/1914 | Rosolofsky | 441/103 |
| 1,253,370 | 1/1918 | Gieracki | 441/103 |
| 1,256,488 | 2/1918 | Smith | 441/103 |
| 2,306,196 | 12/1942 | Temple | 441/103 |
| 4,455,683 | 6/1984 | Moretti | 441/103 |

FOREIGN PATENT DOCUMENTS

| | | | |
|---|---|---|---|
| 645493 | 11/1950 | United Kingdom | 441/103 |

*Primary Examiner*—Joseph F. Peters, Jr.
*Assistant Examiner*—Clifford T. Bartz
*Attorney, Agent, or Firm*—Eugene Chovanes

[57] ABSTRACT

A life-saving suit to help keep a person warm in cold water, which is formed of sheet plastic and capable of being folded into a compact package and readily made available for emergency use.

1 Claim, 2 Drawing Sheets

26
24
23
2.
23
32
25
32
2.
20
22

23
30
31
21
21
27
27

40
46
41
45
43
41
42
48
48
48

COMPACT LIFE-SAVING SUIT

This application is a continuation of application Ser. No. 317,025, filed Nov. 2, 1981, now abandoned.

BACKGROUND OF THE INVENTION

Of great concern when an individual is accidentally thrown into a body of water, such as in boating mishaps, is the chilling effect of the water on the person.

Of further concern is of course the desirability of keeping a person buoyant in the water, so that he doesn't sink and drown. In many instances, by law, it is necessary for a boat or ship occupant to have available a buoyant life jacket which permits the person to remain afloat.

However, the problem of the chilling effect of the water remains, and it is often this factor which, in some instances, in a matter of minutes causes a person to lose consciousness and die.

Many efforts have been made to provide a suitable suit which is intended to be worn when a person is accidentally thrown into the water, wherein the suit provides protection to the wearer by conserving heat and providing insulation from the cold water. These suits have been expensive, complicated, and have not met with success since the need for the suit occurs unexpectedly and in virtually all instances, such suit is unavailable.

SUMMARY OF THE PRESENT INVENTION

I provide a compact life-saving suit which can be folded into a very small packet which can be readily attached, as by a safety pin, to the strap of a life jacket. Since the suit is formed of an impermeable sheet material, including for instance a plastic sheet, the suit can be made in enormous quantities, and at virtually a negligible cost, whereby the suits can be distributed and made prevalent wherever a life jacket is prevalent.

The suit is a mass-produced item of low cost whereby it can be made available to everyone when needed. Availability is a key concern when the need arises.

The suit is desirably symmetrical and is such that it doesn't matter whether the person steps in frontward or backward. The suit as constructed has a long neck with a drawstring and one can either secure the opening around the neck or over the head in parka fashion. In either event, one can step into the suit in either direction—in either a frontal or backward direction.

The suit further permits the use of a life jacket and all one's clothes as insulation, since the suit is intended to be placed over the life jacket which is being worn by the person. The life jacket keeps the person in a relatively upright position with the head above water. Without such life jacket, there would be a possibility for air to collect in the extremities of the suit, possibly the feet, and the air pockets could conceivably result in a person's being suspended in the water in an upside-down position.

The suit further permits one to use the insulating effects of normal clothing which is worn, for instance, on shipboard or in boating. Since the life-saving suit prevents constant exchange of cold water and prevents water from soaking the clothing and getting next to the skin whereby body heat is constantly removed, the suit permits the clothing being worn by the person to aid in trapping body heat and providing warmth from the outside chilling effects of the cold water.

The primary effect is that the life-saving suit be used in the manner of a dry suit wherein water is kept away from the skin of the person. However, the suit also can provide for the well-known "wet suit" effect where the suit can isolate water that is already next to the skin so that the water can be warmed and act as an insulator. This may occur where the person does not have time to done the lifesaving suit, prior to getting wet. The suit prevents transfer of the cold outside water to the warmed-up inside water.

PRIOR ART PROBLEMS

A great problem with the prior art is that all the suits and devices are complicated and expensive. A life-saving suit of this sort must be:

(1) stored easily and not in the way, and
(2) very readily available when you need it, and
(3) the suits must be practically available in quantities of millions so they can be individually stored in numerous places.

Prior art life-saving suits have been complicated and expensive, and bulky to store, and hence have not met with any degree of success.

DESCRIPTION OF THE PREFERRED EMBODIMENT

Figures 1, 2, 2A:
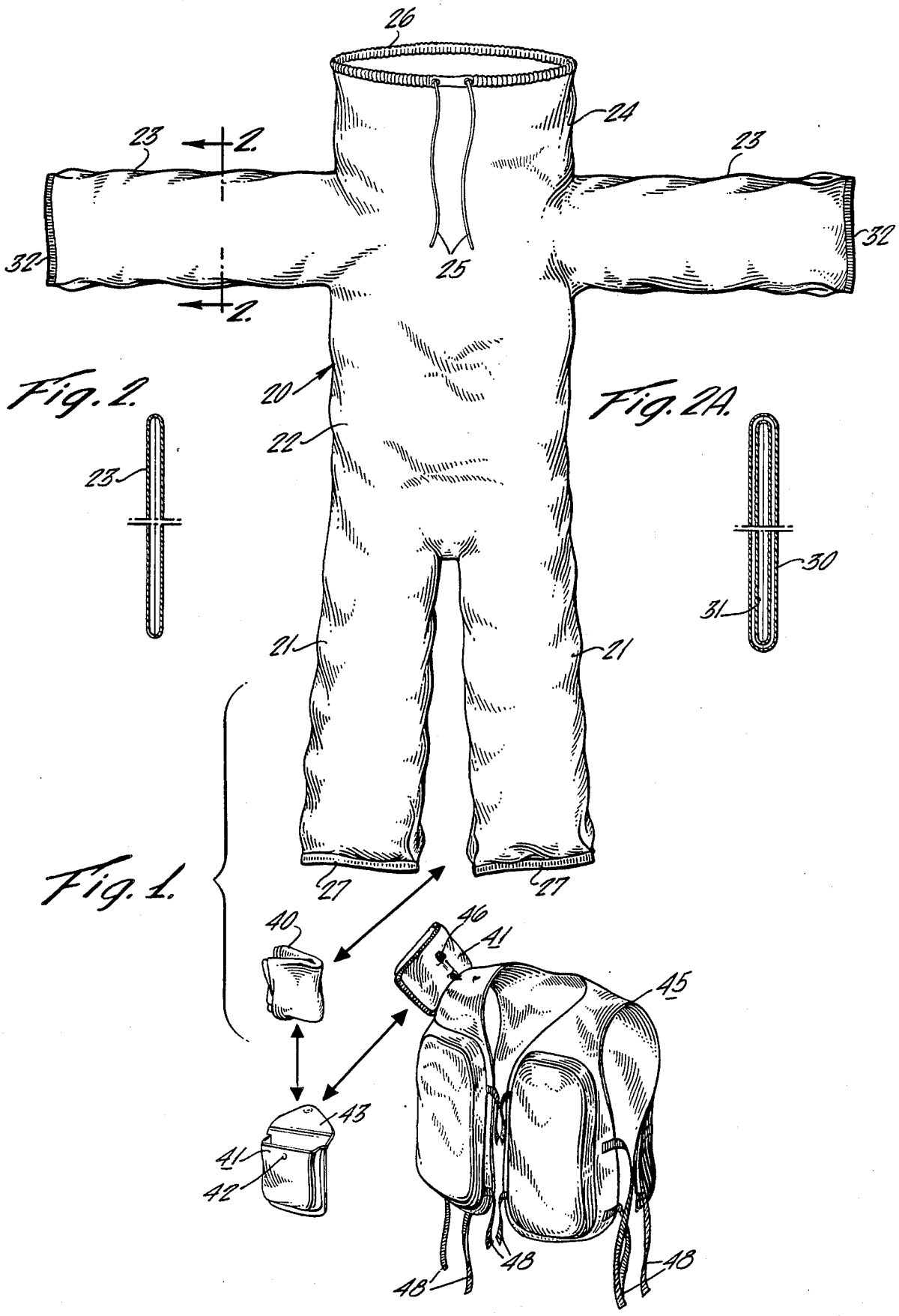
FIG. 1 is a schematic view of the life-saving suit, at the top of the figure, in extended condition. The suit is also shown in a folded condition ready to be inserted into a container packet which is shown attached to a life-saving jacket.
FIG. 2 is a section taken on the line 2-2 of FIG. 1.
FIG. 2A is a section similar to FIG. 2 showing a suit with a modified wall construction.

There is shown in FIG. 1 a life-saving suit 20 having legs 21, a torso 22, arms 23, and a neck or head portion 24. The neck portion has atop thereof drawstring 25 threaded through a suitable channel 26. The suit likewise has leg closures 27.

The suit is desirably formed of a sheet of impervious material such as a common plastic of the type used for instance in plastic sheeting, or plastic garbage bags, such as polyethylene.

In the alternative, the suit can be constructed of a double layer wall as shown in FIG. 2A. In this instance, there is a two-layer effect 30 and 31 wherein an air space between the layers provides further insulation. Suitable means, such as a stem with a stopper, are provided so that the wearer can inflate the wall so that the layers of material are separated with a layer of air. This inflation can be done by a person before or, in an emergency, after a person is in the water. Such double layers or quilting construction, can be formed by heat-sealing two layers of plastic together at spaced locations.

The suit is so constructed that it is relatively large and bulky so that a person has no problem in getting into the suit. The top head area 26 is very large in opening, and in fact is equal to the torso diameter at 22. This permits a person under the stress of the emergency to readily get into the suit and draw it up over one's shoulders after inserting one's legs into the legs of the suit 21 and drawing the suit up over the body and inserting arms into arm portions 23 of the suit.

The leg portions 21 have at their extremity closures 27 which are simply sealed portions, as by heat-sealing, of the leg extensions 21. There are likewise at 32 closures or seals as for instance heat seals at 32. Such seals can be readily made as well known by simply heat-sealing the plastic together under a hot blade or the like.

The suit when folded forms a very compact package as shown at 40. The folding can take place in any fashion, as for instance, bringing the legs against the torso portion, and the arms overlapping the legs. Such compact packet can be of for instance the size of 6"×3"×1" and such packet can be readily inserted into an inexpensive simple case 41, having some closure arrangement such as a snap at 42 with a tab or cover 43. The packet 41 containing the folded, life-saving suit 20 is desirably attached to a life jacket 45 by an inexpensive securing means, such as a safety pin 46 or the like.

In use, in an emergency, a person reaches for a life jacket 45 and dons the life jacket in the well known fashion, making the life jacket secure to the person's body by means of straps 48. In some instances, as in boating, the person may already be wearing the life jacket when the emergency arises. Immediately after donning the life jacket 45, the person opens up packet 41 which is secured to the life jacket 45, and removes the life-saving suit 20 whereupon the suit is unfolded into the condition as shown in the upper portion of FIG. 1. The person dons the suit by placing his feet into the leg portions 21 and by placing his arms into portions 23, and then by drawing the suit up over the head as seen in FIG. 3 wherein the drawstring 25 is suitably tightened and knotted, so that the wearer's face 50 is exposed in parka fashion.

In the alternative, the drawstring can be secured around the person's neck so the entire head remains exposed outside the suit.

Figure 3:
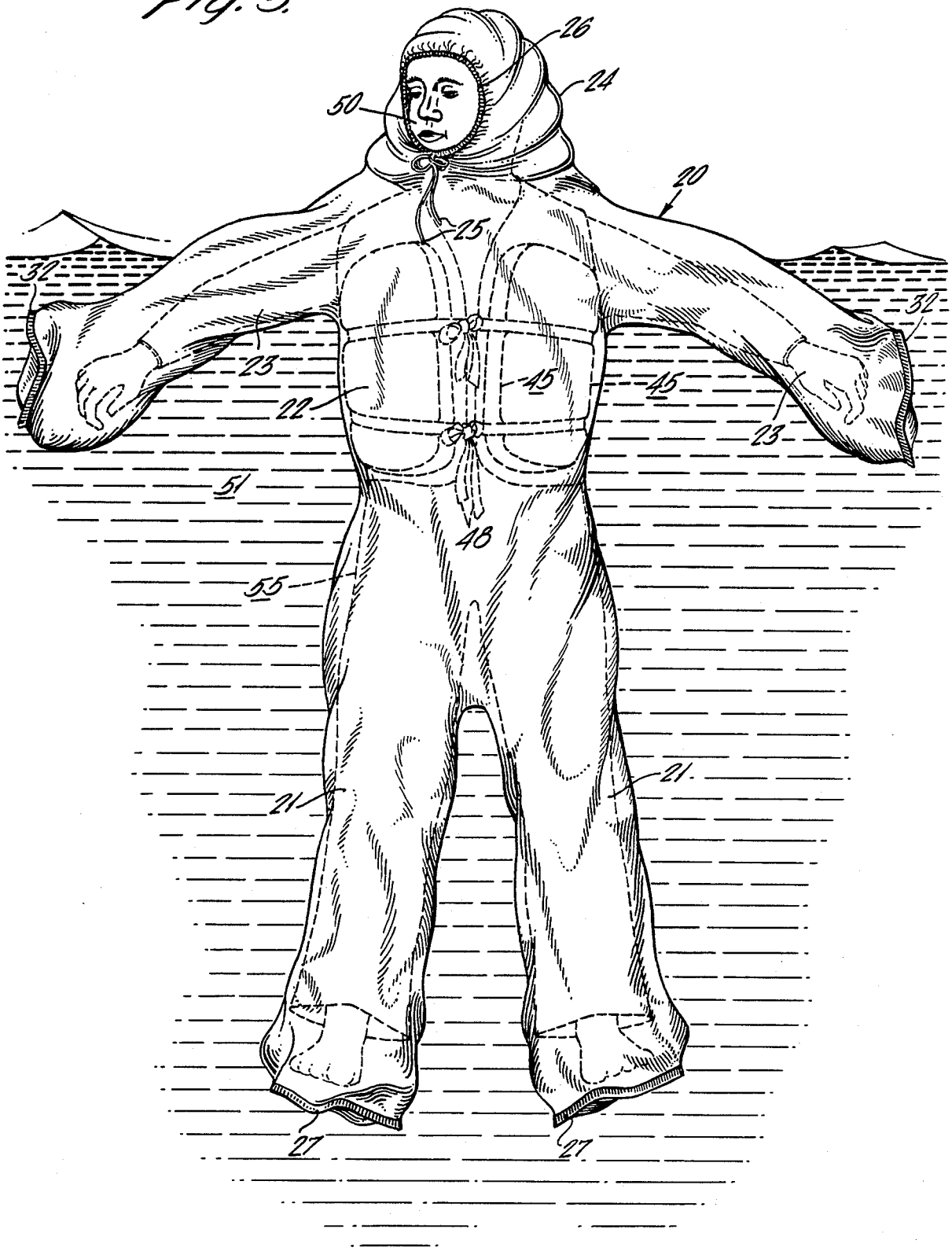
FIG. 3 is a schematic view of a person submerged in the water, wearing the life-saving suit of the invention.

As seen in FIG. 3, the person will remain in an erect position in cold water 51 by virtue of the buoyancy effect of life jacket 45. The life-saving suit 20 encompasses the wearer's entire body 55, as seen in FIG. 3 and permits movement of the person as would be possible without the suit, so there is little interference to locomotion as for instance by swimming.

The insulating effect of the suit permits the wearer to retain body heat by keeping out the water away from the person's clothing, and from the life jacket itself. Thus, the person's clothing and life jacket conserve body heat and act to entrap air around the person's body, thus permitting the air to act as an insulator from the cold and chilling effects of the water.

Where the person becomes wet before the suit is donned, the suit keeps the water already next to the skin from flowing away and permits a "wet suit" effect to take place wherein the water next to the skin is warmed by the person's body heat.

In view of my invention and disclosure, variations and modifications to meet individual whim or particular need will doubtless become evident to others skilled in the art, to obtain all or part of the benefits of my invention without copying the structure shown, and I therefore claim all such insofar as they fall within the reasonable spirit and scope of my claims.

What I claim as new and desire to secure by Letters Patent is:

1. A life-saving suit having a front and back for emergency wear, capable of being folded into a compact packet, formed of an impermeable sheet of plastic material, and having (a) a torso portion, (b) leg portions, (c) arm portions, and (d) a neck portion with tie-string closure means, the leg and arm portions being sealed at their extremities, and the front and back shape of the suit being identical except for the tie-string closure means, the suit being sized such that it can be unfolded and worn over clothing and a life jacket worn by a person, while the person is in the water; whereby the person is insulated from the chilling effects of the water by the air in the suit, in combination with a case having dimensions approximately the same as the folded packet, said case being removably attached to a life-saving jacket, said suit being sized such that it will fit over a person wearing outer clothing, and wearing a life jacket, whereby the person when submerged in cold water is held in a buoyant fashion, while being kept warm by the insulating effects of the person's clothing and the life jacket.

* * * * *